US005529757A

United States Patent [19]

Kaufmann

[11] Patent Number: 5,529,757

[45] Date of Patent: Jun. 25, 1996

[54] APPARATUS FOR REDUCING EMISSIONS OF POLLUTANTS

[76] Inventor: Klaus-Dieter Kaufmann, Morassistrasse 26, München D.80469, Germany

[21] Appl. No.: 277,266

[22] Filed: Jul. 21, 1994

[30] Foreign Application Priority Data

Jul. 21, 1993 [DE] Germany ..... 43 24 495.5

[51] Int. Cl.[6] ..... B65D 88/48

[52] U.S. Cl. ..... 422/168; 220/217; 422/42

[58] Field of Search ..... 422/2, 105, 108, 422/168, 40–43; 220/227, 217, 228, 221, 222

[56] References Cited

U.S. PATENT DOCUMENTS

| | | | |
|---|---|---|---|
| 1,404,924 | 1/1922 | Bloss | 220/221 |
| 1,906,685 | 5/1933 | Wiggins | 220/217 |
| 1,913,643 | 6/1933 | Smith | 220/221 X |
| 2,297,985 | 10/1942 | Rivers | 220/227 |
| 2,541,090 | 2/1951 | Orr et al. | 220/217 X |
| 3,618,812 | 11/1971 | Maeder | 220/220 |
| 4,099,644 | 7/1978 | Nuttall et al. | 220/222 X |
| 4,173,291 | 11/1979 | Hills | 220/222 X |
| 4,209,271 | 6/1980 | McCabe et al. | 220/217 X |
| 5,147,418 | 9/1992 | Laverman et al. | 95/90 |
| 5,150,805 | 9/1992 | Vinals | 220/217 |
| 5,284,269 | 2/1994 | Petrie et al. | 220/221 X |

FOREIGN PATENT DOCUMENTS

| | | |
|---|---|---|
| 497032 | 4/1975 | Australia . |
| 0067428 | 12/1982 | European Pat. Off. . |
| 2162928 | 7/1973 | France . |
| 2439727 | 5/1980 | France . |
| 1998492 | 12/1968 | Germany . |
| 1715884 | 7/1971 | Germany . |
| 2453789 | 5/1975 | Germany . |
| 1774782 | 10/1976 | Germany . |
| 3014166 | 10/1981 | Germany . |
| 3335918 | 4/1984 | Germany . |
| 9100735 | 11/1992 | Netherlands . |

OTHER PUBLICATIONS

Translation of French Patent No. 2,439,727.

*Primary Examiner*—Timothy M. McMahon
*Assistant Examiner*—Robert Carpenter
*Attorney, Agent, or Firm*—Jacobson, Price, Holman & Stern

[57] ABSTRACT

An apparatus is also described for reducing pollutant emissions into the surrounding air from storage of liquid materials in a tank having a cover which is movable in the vertical direction in the tank and moves along with the fill level of the liquid material being stored, wherewith an edge gap is present between the outer perimeter of the cover and the inner wall of the tank, which edge gap is filled with a sealing liquid which has a lower density than the liquid material being stored, and has a vapor pressure which is low in comparison to that of the liquid material being stored.

13 Claims, 1 Drawing Sheet

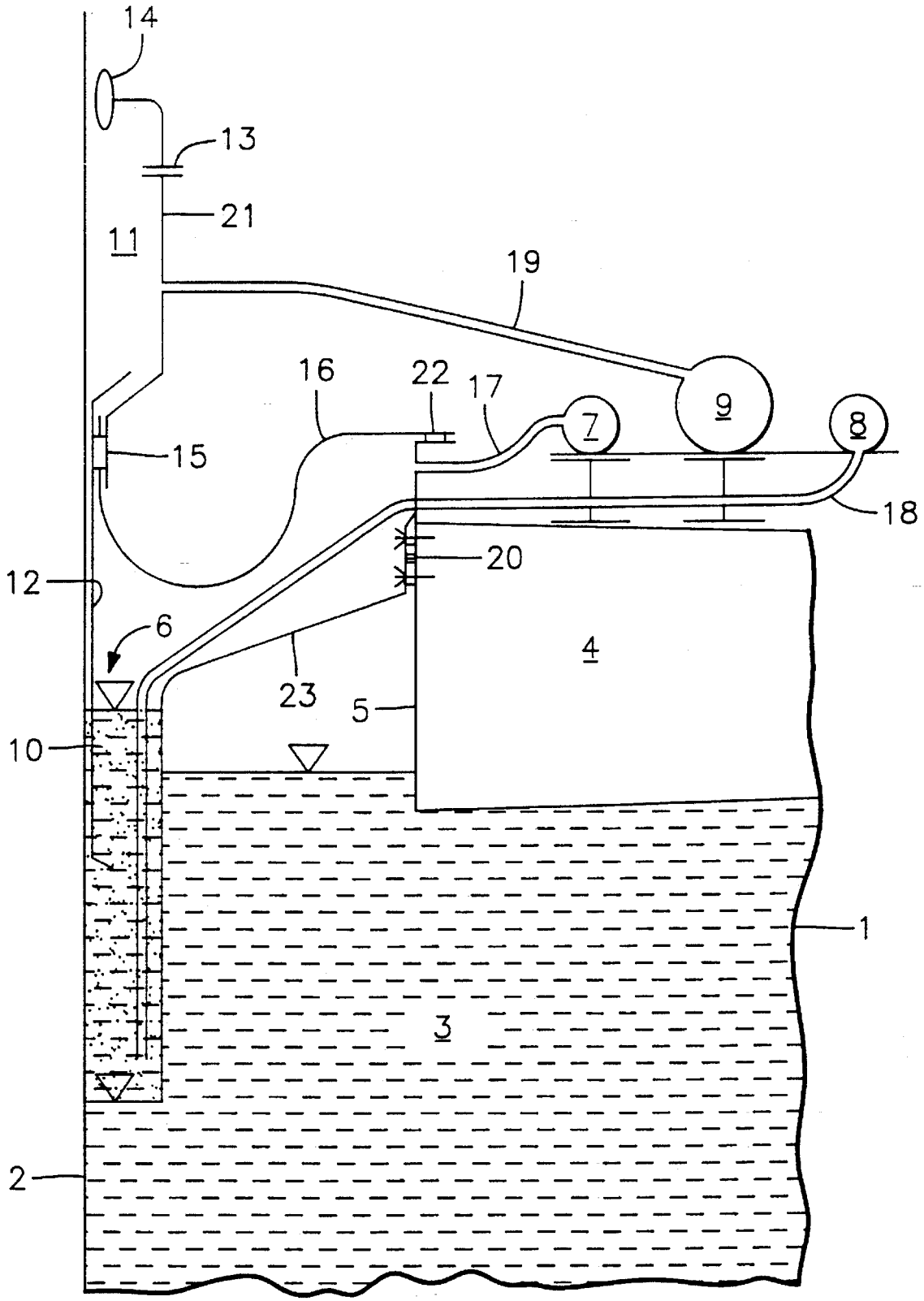
14
13
21
11
19
16
22
17
7
9
8
15
18
20
12
6
4
23
5
10
1
3
2

APPARATUS FOR REDUCING EMISSIONS OF POLLUTANTS

FIELD OF THE INVENTION

The invention is generally applicable in the area of air pollution control, and relates in particular to a method and apparatus for reducing emissions of pollutants into the surrounding air where liquid materials are stored in tanks having a cover which is vertically movable inside the tank and follows the fill level of the liquid material.

BACKGROUND OF THE INVENTION

Tanks with such a floating cover are presently used on a wide scale, in particular for storing liquid materials of the petrochemical type, e.g. mineral oil and mineral oil products. In such tanks heretofore, the edge gap between the outer perimeter of the cover and the inner wall of the tank has been sealed to prevent upward escape of the liquid, with the aid of a device comprised of a lever bar with counterloads, sliding plates, and flexible wiper-type strips.

However, the known sealing means will not suffice to meet more stringent future environmental protection requirements, and thus it will be necessary to retrofit current tank apparatuses or to construct completely new tanks. According to the state of the art prior to the present invention, essentially two alternatives are presented for consideration: Either the method of gas displacement, or (for liquid materials of suitable hazard classes) the use of a fixed-roof tank with a floating cover, wherewith air exhaust and gas emissions are sent to an apparatus which performs waste gas disposal and/or vapor recovery.

Both of these alternatives are attended by significant drawbacks. The method of gas displacement does indeed avoid emissions of pollutants, but it is not practicable in a number of applications, e.g. intermediate storage of crude oil in crude-oil tanks, where this oil is in the process of being pumped over relatively long pipelines. In the case of fixed-roof tanks with associated disposal and recovery apparatuses for the gases and vapors which are produced, in addition to high construction costs one is faced with major operating difficulties, because said disposal- and recovery apparatuses will periodically require maintenance, and in such cases (as well as in cases of unexpected repairs) the tanks will have to be emptied. Furthermore, the continuous operation of such apparatuses consumes substantial energy, which itself is detrimental to the environment.

Accordingly, the underlying problem of the present invention is to devise means of controlling emissions of pollutants to levels heretofore only attainable with the gas displacement method, but without changing the customary floating cover tank structure which is of simple design and is easy and inexpensive to operate, and without adding costly additional equipment.

SUMMARY OF THE INVENTION

In the context of the invention, the tank has a relatively narrow region near its edge, in which a sealing liquid which is compatible with the liquid material being stored is disposed above the liquid material being stored; the sealing liquid has a lower density than the stored liquid and a substantially lower vapor pressure.

The result is to prevent escape of either liquid or gaseous/vaporous pollutants through the gap between the inner wall of the tank and the outer perimeter of the cover which cover is movable in the tank.

Additional sealing liquid may be added as needed, or continuously, and the sealing liquid may be treated so as to avoid excessive buildup of pollutants within the sealing liquid itself. Sealing liquid withdrawn in connection with this feature may undergo purification for reuse as a sealing liquid according to the invention, or may be utilized otherwise, as a fuel or the like.

The invention also comprises means of completely blocking exit of gases, by capturing said gases in a special collecting space and then treating them separately.

According to another feature, resistant deposits on the inner wall of the tank, from the liquid material being stored, which deposits do not tend to be dissolved and carried along by the sealing liquid as the sealing liquid moves along the tank wall, may be removed with mechanical means such as scrapers or by a form of chemical treatment with solvents, particularly at elevated temperature, thereby preventing the deposits from penetrating into the external space.

BRIEF DESCRIPTION OF THE DRAWINGS

For further elucidation of the invention, its features, and its advantages, reference is now made to the Figure, which illustrates the structure and operation of a preferred exemplary embodiment.

The FIGURE shows a schematic cross section of an edge region of a tank and the cover of the tank, provided with an apparatus according to the invention, for the purpose of sealing the tank.

DETAILED DESCRIPTION OF THE PREFERRED EMBODIMENT

The commercial liquid material 3 is being stored in a tank 1. A cover 4 floats on the liquid 3 and is vertically movable in tank 1 so as to follow changes in the fill level of the liquid 3.

A relatively narrow edge gap 6 is left between the inner wall 2 of the tank and the outer perimeter 5 of the cover 4. This gap is filled with a sealing liquid 10 which adjoins the inner wall 2 of the tank 1. The edge gap 6 is separated from the main mass of the liquid material 3 by a separating plate 23 which is connected to the cover 4 via an elastic coupling member 20 (e.g. a pleated or corrugated strip-type connector); plate 23 accompanies the cover 4 in vertical movement when the level of the liquid material 3 in the tank 1 rises or falls. A curved member 16 comprised of sheet metal seals the edge gap 6 with respect to the environment; member 16 is connected to cover 4 via a seal 22, and to some extent flexibly moves with cover 4.

The sealing liquid 10 is selected to be compatible with the liquid material 3, in its chemical properties. In particular, the candidates for use as the sealing liquid 10 include distillate fractions of the liquid material 3. The sealing liquid should have a lower density than liquid material 3, and substantially lower vapor pressure. In this way, the penetration of the liquid material 3 into the sealing liquid 10 is substantially avoided, nor will there be appreciable evaporation from the sealing liquid 10. Particularly if the liquid material 3 is crude oil or a mineral oil product, aliphatic hydrocarbons, particularly normal alkanes with 6 or more C atoms per molecule, are suitable as the sealing liquid 10. Preferred examples are the $C_7$–$C_{13}$-alkanes, particularly the $C_9$–$C_{11}$-alkanes.

When the liquid level of the liquid material 3 in tank 1 moves downward, the cover 4 also moves downward, and with it the separating plate 23 and the curved member 16; the sealing liquid follows this downward movement along the inner wall 2 of the tank 1. In the process, residues of liquid material 3 which linger at the inner wall 2 of tank 1 are forced away by the sealing liquid 10 to a substantial degree, while liquid 10 takes their place. Trace residues of liquid material 3 having relatively high vapor pressure are absorbed by the sealing liquid 10. Accordingly, no appreciable quantities of components of the liquid material 3 having relatively high vapor pressure are released to the vapor space above sealing liquid 10 as the liquid level in tank 1 moves downward.

A glide shoe 12 extends into the edge region filled with the sealing liquid 10, which shoe 12 extends parallel to and adjacent to the inner wall 2 of the tank 1, and slides along in coordination with the movement of the cover 4 along the inner wall 2 of the tank 1. Shoe 12 may bear scrapers on its side facing the inner wall 2 of the tank 1, which scrapers serve to dislodge solid deposits which adhere to the inner wall 2; in this way, the wall surface is left free of residues, and thus such residues do not serve as a source of pollutant emissions.

For loading the sealing liquid 10 into the edge gap 6, a feed line 17 is provided which may branch off from a much higher diameter main line 7 disposed on the upper side of the cover 4, wherewith sealing liquid 10 is supplied to line 17 from line 7. In addition, a withdrawal line 18 is provided in the sealing liquid 10 in the edge gap 6, which line 18 leads to a much higher diameter main collecting line 8 also disposed on the upper side of the cover 4. With the aid of this system of conduits it is possible to fill the edge gap 6 with sealing liquid 10 and subsequently to replace or replenish such liquid as may be desirable.

The replacement of the sealing liquid 10 may be carried out as a continuous process. It may be controlled depending on the buildup of residues from liquid material 3, or other contaminants, in the sealing liquid 10. Sensors (not shown) may be provided for purposes of this control, which respond to changes in properties of the sealing liquid 10 which occur upon buildup of contaminant(s). In particular, the instantaneous density or the light permeability of the sealing liquid 10 may serve as a control criterion for replacement of liquid 10.

Adjacent to and above the edge gap 6 along the inner wall 2 of the tank 1 a gas collecting space 11 is provided which is delimited by a wall 21 which is connected at its lower edge (with interposition of a seal 15) to the curved covering member 16 and bears a shoe-mounted seal 14 on its upper edge which seal 14 presses against the inner wall 2 of the tank 1; seal 14 can glide along wall 2 when the gas collecting space 11 is moving upward or downward in coordination with the movement of the cover 4. The wall 21 of the gas collecting space 11 also contains calibrated openings 13, through which the gas collecting space 11 can be aerated or can be supplied with inert gas. In addition, the openings 13 in wall 21 can be used to introduce a solvent into the gas collecting space 11, whereby residue layers adhering to the inner wall 2 of the tank 1 can be dissolved away; the solvent (water vapor or steam) may be heated or may be in vapor form. In addition, a suction line 19 opens out into the gas collecting space 11; line 19 leads to a much larger diameter collecting line 9 for gas, disposed on the cover 4. The contents of the gas collecting space 11 can be withdrawn through the suction line 19, and if desired an adjustable underpressure may be established and maintained in space 11 via line 19.

The purpose of the gas collecting space 11 is to reliably prevent evaporation of liquid residues from the inner wall 2 into the surroundings, e.g. if such residues are present despite the forcing out of liquid material 3 by the sealing liquid 10. Such liquid residues surviving between the glide shoe 12 and the inner wall 2 of the tank 1 will evaporate in the gas collecting space 11 and will be removed through the suction line 19 and the associated collecting line 9, from which they may be recovered or otherwise disposed of. External air or inert gas supplied via the openings 13 may serve to lower the partial pressure of the liquid vapors in the gas collecting space 11, and to promote complete evaporation of liquid residues present in the gas collecting space 11.

It may be seen from the preceding description that the described apparatus and method enable reliable removal of pollutant residues to prevent them from being emitted into the environment, so as to meet the most stringent environmental protection regulations.

Basically the invention comprises a method of reducing pollutant emissions into the surrounding air from storage of liquid materials in a tank having a cover which is movable in the tank in the vertical direction and moves along with the fill level of the liquid material being stored, wherewith according to the method, measures are implemented in the region of the edge gap between the outer perimeter of the cover and the inner wall of the tank, for sealing against penetration of liquid upward, which measures comprise filling the edge gap with a sealing liquid which has a lower density than the liquid material being stored, and has a vapor pressure which is low in comparison to that of the liquid material being stored.

As an additional feature, an essentially confined atmosphere may be provided adjoining the edge gap filled with the sealing fluid, which atmosphere may be fed external air and/or inert gas and may be maintained at an (adjustable) underpressure with respect to the exterior; and/or the atmosphere may have fed into it heated gas and/or solvent vapor (particularly water vapor or steam) of elevated temperature.

The principal subject matter of the invention also comprises an apparatus for reducing pollutant emissions into the surrounding air from storage of liquid materials in a tank having a cover which is movable in the vertical direction in the tank and moves along with the fill level of the liquid material being stored, wherewith an edge gap is present between the outer perimeter of the cover and the inner wall of the tank, which edge gap is filled with a sealing liquid which has a lower density than the liquid material being stored, and has a vapor pressure which is low in comparison to that of the liquid material being stored.

Further, a gas collecting space may be provided adjacent to the edge gap, which gas collecting space is in fluid communication with the edge gap and is at an (adjustable) underpressure with respect to the exterior; and/or the gas collecting space may be supplied (via suitable openings) with external air and/or may have inert gas fed to it.

I claim:

1. An apparatus for reducing pollutant emissions from being released into the surrounding air, said apparatus comprising a tank, a liquid product stored in said tank, a cover floating on said liquid product so as to follow changes of a fill level in said tank in a vertical direction, an edge gap between an outer perimeter of said cover and an inner wall of said tank, a sealing liquid having a lower density and a lower vapor pressure than said liquid product and filling said edge gap above said liquid product, said sealing liquid being capable of absorbing and removing any remainder of said liquid product from said inner wall of said tank left thereon upon reduction of said fill level in said tank, and a gas collecting space provided adjacent to and in fluid communication with said edge gap so as to receive any gas escaping past and from said sealing liquid, a glide shoe being located in said edge gap in a region near to said inner wall of said tank and being disposed to be movable in a vertical direction parallel to said inner wall of said tank.

2. An apparatus according to claim 1, wherein said sealing liquid is a distillate fraction of said liquid product.

3. An apparatus according to claim 1, wherein said sealing liquid is selected from the aliphatic hydrocarbons having 6 or more C atoms per molecule.

4. An apparatus according to claim 3, wherein said sealing liquid comprises at least one alkane from the range of heptane to tridecane.

5. An apparatus according to claim 1, further comprising feed and withdrawal lines for replenishing and withdrawing said sealing liquid in said edge gap, respectively.

6. An apparatus according to claim 5, wherein pumps are connected to said feed and withdrawal lines for continually circulating said sealing liquid through said edge gap.

7. An apparatus according to claim 1, wherein said edge gap is delimited by a separating plate connected to said cover so as to move in coordination with said cover in a direction parallel to said inner wall of said tank.

8. An apparatus according to claim 7, wherein said separating plate is connected to said cover by an elastic connecting member.

9. An apparatus according to claim 1, wherein said gas collecting space is at an adjustable underpressure with respect to an exterior space pressure.

10. An apparatus according to claim 1, wherein said gas collecting space is provided with openings leading to an exterior space to be supplied with external air.

11. An apparatus according to claim 1, wherein said gas collecting space is provided with means for adjustably supplying said gas collecting space with inert gas.

12. An apparatus according to claim 1, wherein said gas collecting space has at least one of feeding and withdrawal lines for at least one of gas and a sealing liquid opening thereto.

13. An apparatus according to claim 12, wherein said cover carries collector lines on an outer surface communicating with said at least one of feeding and withdrawal lines for gas and for sealing liquid respectively.

* * * * *